US007500939B2

(12) United States Patent
Chen

(10) Patent No.: US 7,500,939 B2
(45) Date of Patent: Mar. 10, 2009

(54) MULTI-STAGE ORIENTATING ASSEMBLY FOR AN INVERSION TABLE

(75) Inventor: Shi-Lin Chen, Taichung Hsien (TW)

(73) Assignee: Lifegear Taiwan Ltd., Daya Hsiang, Taichung Hsien (TW)

( * ) Notice: Subject to any disclaimer, the term of this patent is extended or adjusted under 35 U.S.C. 154(b) by 0 days.

(21) Appl. No.: 11/737,680

(22) Filed: Apr. 19, 2007

(65) Prior Publication Data

US 2008/0261790 A1 Oct. 23, 2008

(51) Int. Cl.
*A63B 26/00* (2006.01)

(52) U.S. Cl. ..... 482/144; 482/145; 482/147

(58) Field of Classification Search ..... 482/142–145, 482/907, 908; 297/83, 84, 325, 327; D21/686–690
See application file for complete search history.

(56) References Cited

U.S. PATENT DOCUMENTS 5,028,061 A * 7/1991 Hawkes ..... 280/47.4
6,149,560 A * 11/2000 Kim ..... 482/145
6,484,995 B1 * 11/2002 Nemoto ..... 248/421

* cited by examiner

*Primary Examiner*—Loan H Thanh
*Assistant Examiner*—Daniel F Roland
(74) *Attorney, Agent, or Firm*—patenttm.us

(57) ABSTRACT

A multi-stage orientating assembly for an inversion table has a stationary seat, an orientating device and an operating device. The stationary seat is connected securely to the sidewall of the table of the inversion table and has a longitudinal beam and a connecting jacket. The orientating device is connected to the mounting bracket of the inversion table and the stationary seat and has a mounting head and a clamping device. The mounting head is connected to the connecting jacket. The clamping device is connected to the stationary seat and has an engaging assembly and an orientating assembly. The operating device is connected to the stationary seat and the orientating device and has a transmitting assembly and a handle. The transmitting assembly is connected to the engaging assembly. The handle is connected securely to the transmitting assembly.

4 Claims, 13 Drawing Sheets

MULTI-STAGE ORIENTATING ASSEMBLY FOR AN INVERSION TABLE

BACKGROUND OF THE INVENTION

1. Field of the Invention

The present invention relates to an orientating assembly, and more particularly to a multi-stage orientating assembly for an inversion table, which can be adjusted easily and quickly.

2. Description of Related Art

A conventional inversion table holds a person's body to relax or relieve back pain, and has a mounting bracket, a table and an ankle clamp assembly. The mounting bracket has a front frame and a rear frame. The front frame is H-shaped and has two connecting sheaths and two top ends. The connecting sheaths are respectively mounted around the top ends of the front frame. The rear frame is connected pivotally to the front frame and has two top ends and two bottom ends. The connecting sheaths are respectively connected to the rear frame between the top ends and the bottom ends. The table is attached pivotally between the top ends of the rear frame, holds a person's body before the table is inverted and has a bottom end. The ankle clamp assembly is connected to the bottom end of the table and clamps and holds a person's ankles when the table is pivoted to an inverted position.

However, the conventional inversion table only can provide a single inverted angle of the table relative to the mounting bracket. Thus, this may cause users feeling unexciting and boring, and the conventional inversion table will not attract users to exercise.

The invention provides a multi-stage orientating assembly for an inversion table that mitigates or obviates the aforementioned problems.

SUMMARY OF THE INVENTION

The main objective of the present invention is to provide a multi-stage orientating assembly for an inversion table that can be adjusted easily and quickly.

The multi-stage orientating assembly for an inversion table in accordance with the present invention and has a stationary seat, an orientating device and an operating device. The stationary seat is connected securely to the sidewall of the table of the inversion table and has a longitudinal beam and a connecting jacket. The orientating device is connected to the mounting bracket of the inversion table and the stationary seat and has a mounting head and a clamping device. The mounting head is connected to the connecting jacket. The clamping device is connected to the stationary seat and has an engaging assembly and an orientating assembly. The operating device is connected to the stationary seat and the orientating device and has a transmitting assembly and a handle. The transmitting assembly is connected to the engaging assembly. The handle is connected securely to the transmitting assembly.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
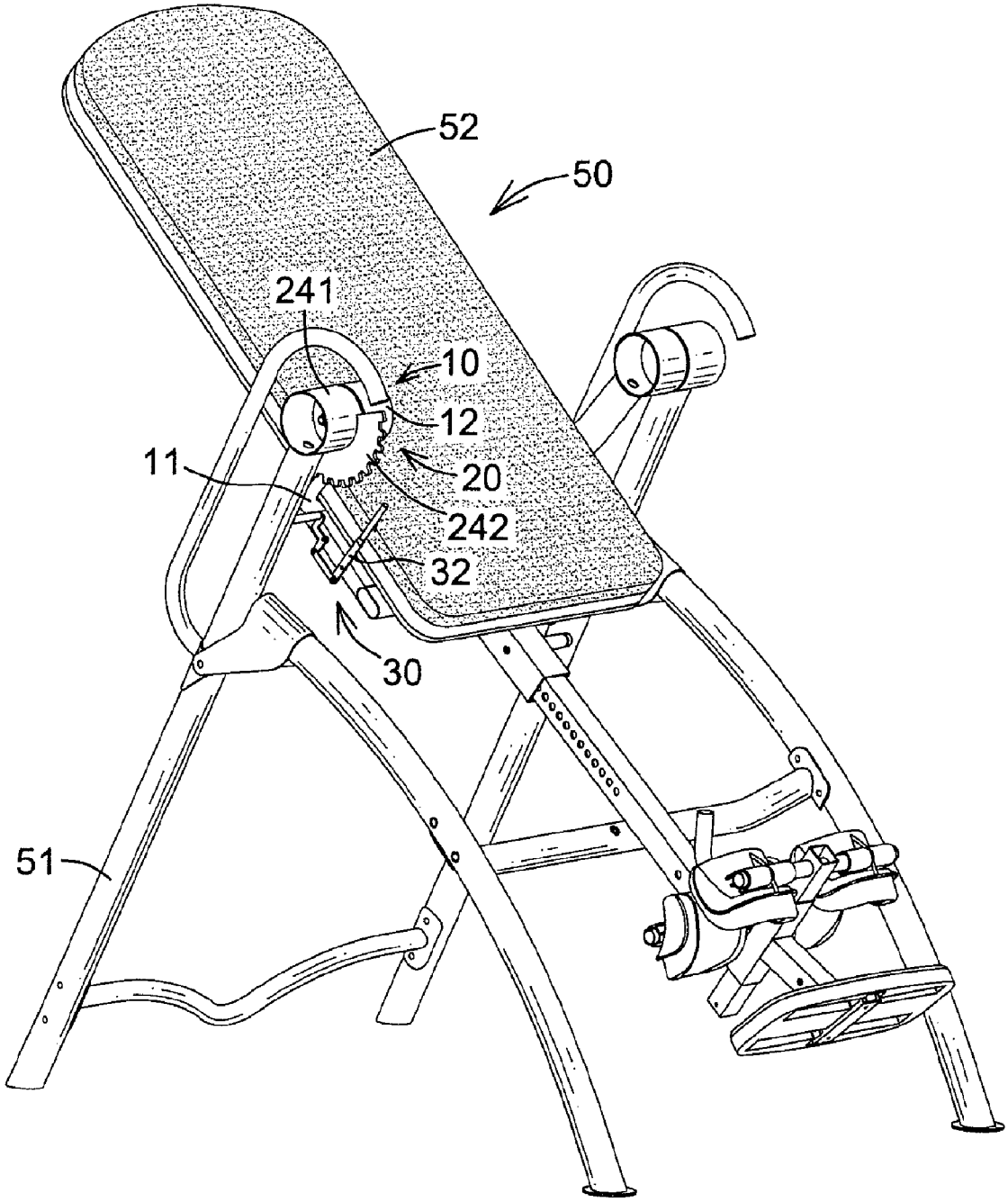
FIG. 1 is a perspective view of a multi-stage orientating assembly for an inversion table in accordance with the present invention.
Figure 2:
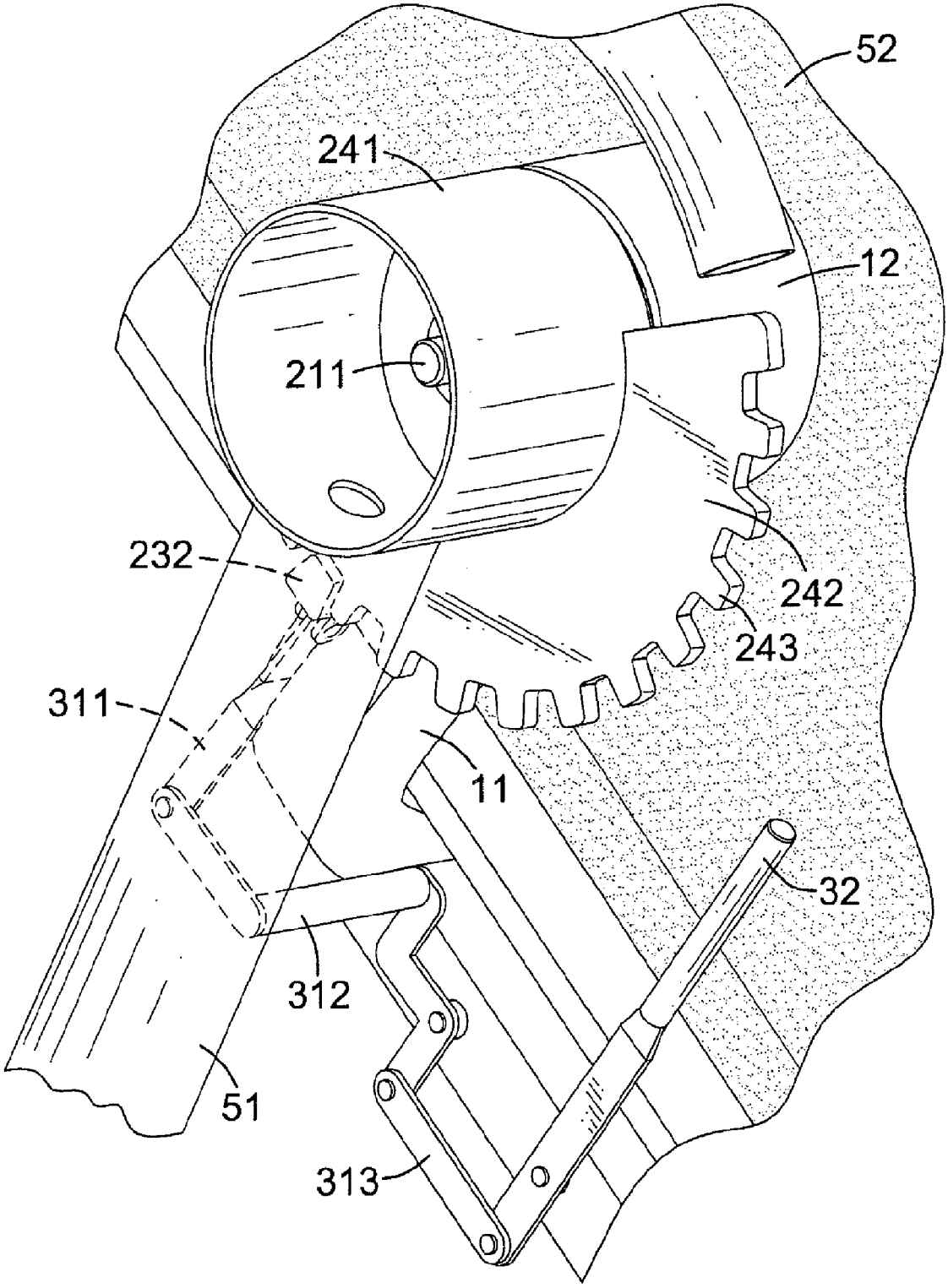
FIG. 2 is an enlarged perspective view of the multi-stage orientating assembly in FIG. 1.
Figure 6:
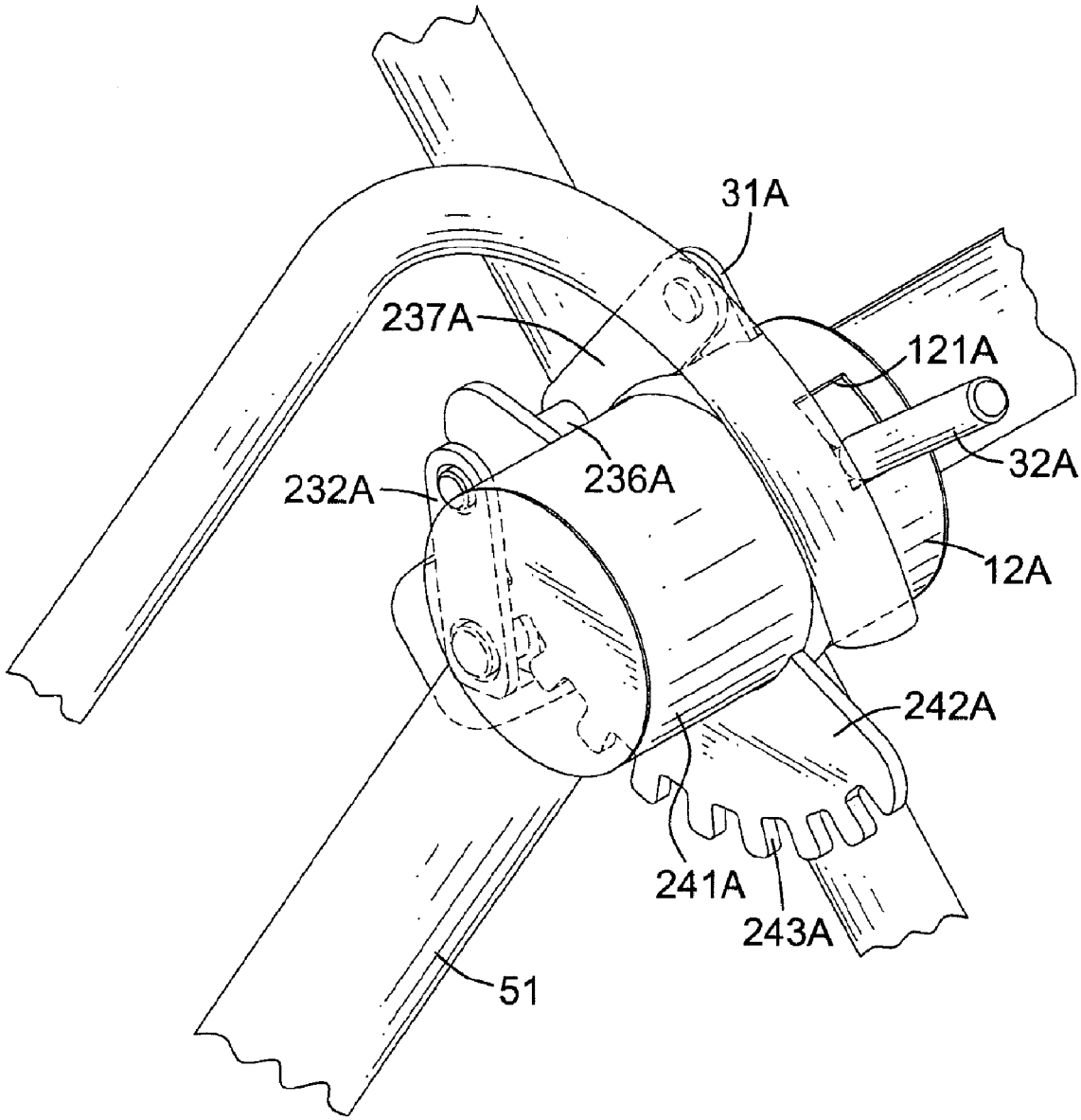
FIG. 6 is an enlarged perspective view of a second embodiment of a multi-stage orientating assembly in accordance with the present invention.
Figure 10:
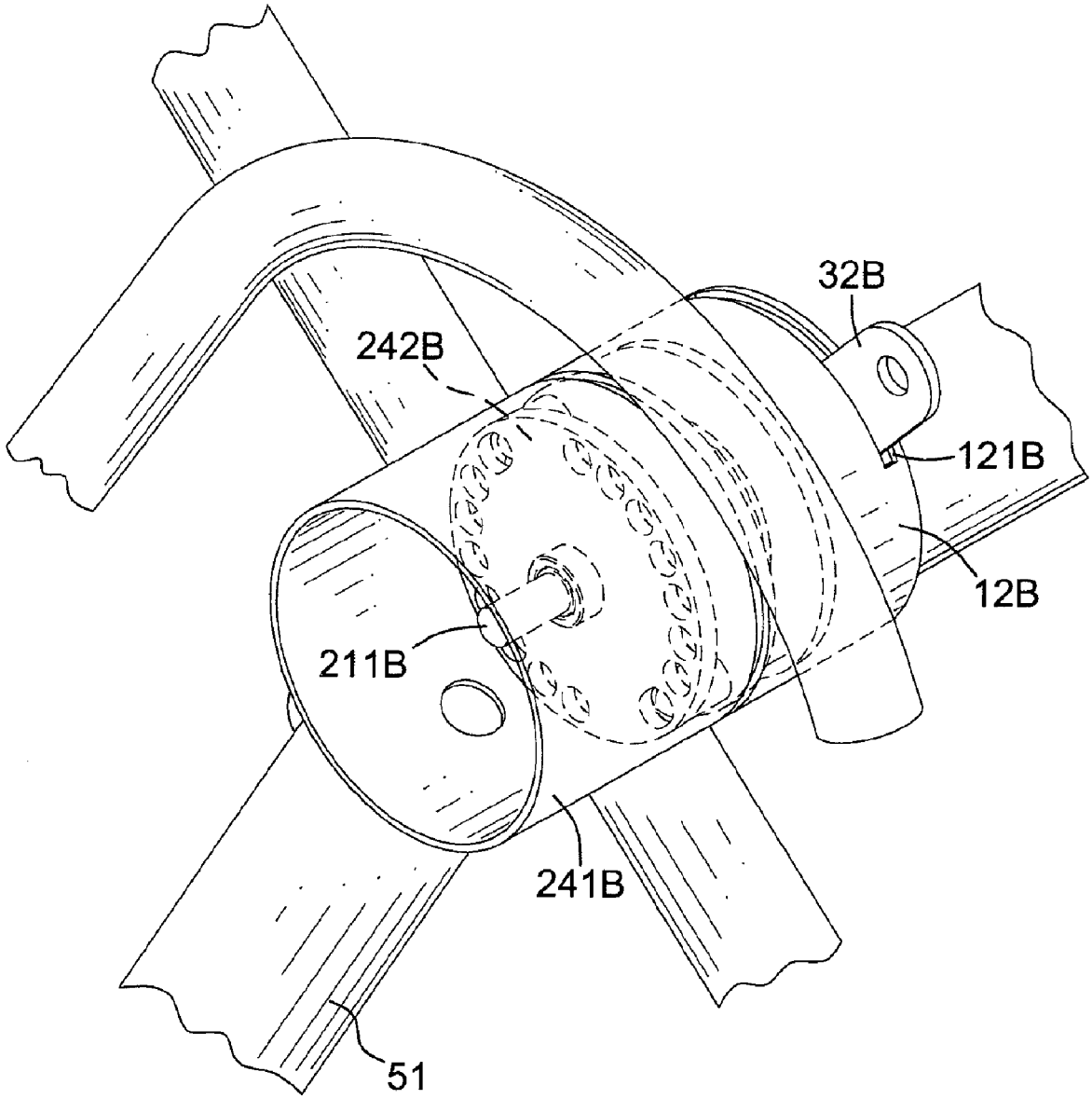
FIG. 10 is an enlarged perspective view of a third embodiment of a multi-stage orientating assembly in accordance with the present invention.

With reference to FIGS. 1, 6 and 10, a multi-stage orientating assembly is used for an inversion table (50) having a mounting bracket (51) and a table (52). The mounting bracket (51) has two top ends, and the table (52) is connected pivotally to the mounting bracket (51) near the top ends and has a sidewall and a bottom face. The multi-stage orientating assembly is connected to the inversion table (50) between the mounting bracket (51) and the table (52) and comprises a stationary seat (10, 10A, 10B), an orientating device (20, 20A, 20B) and an operating device (30, 30A, 30B).

The stationary seat (10, 10A, 10B) is connected securely to the sidewall of the table (52) of the inversion table (50) and has a longitudinal beam (11, 11A, 11B) and a connecting jacket (12, 12A, 12B). The longitudinal beam (11, 11A, 11B) is connected securely to the table (52) of the inversion table (50) and has a bottom end and a top end. The bottom end of the longitudinal beam (11, 11A, 11B) is connected securely to the bottom face of the table (52). The top end of the longitudinal beam (11, 11A, 11B) is protruded up from the table (52). The connecting jacket (12, 12A, 12B) is hollow, is mounted securely to the top end of the longitudinal beam (11, 11A, 11B) and has an inner end, an outer end, an outer surface and a chamber.

Figure 3:
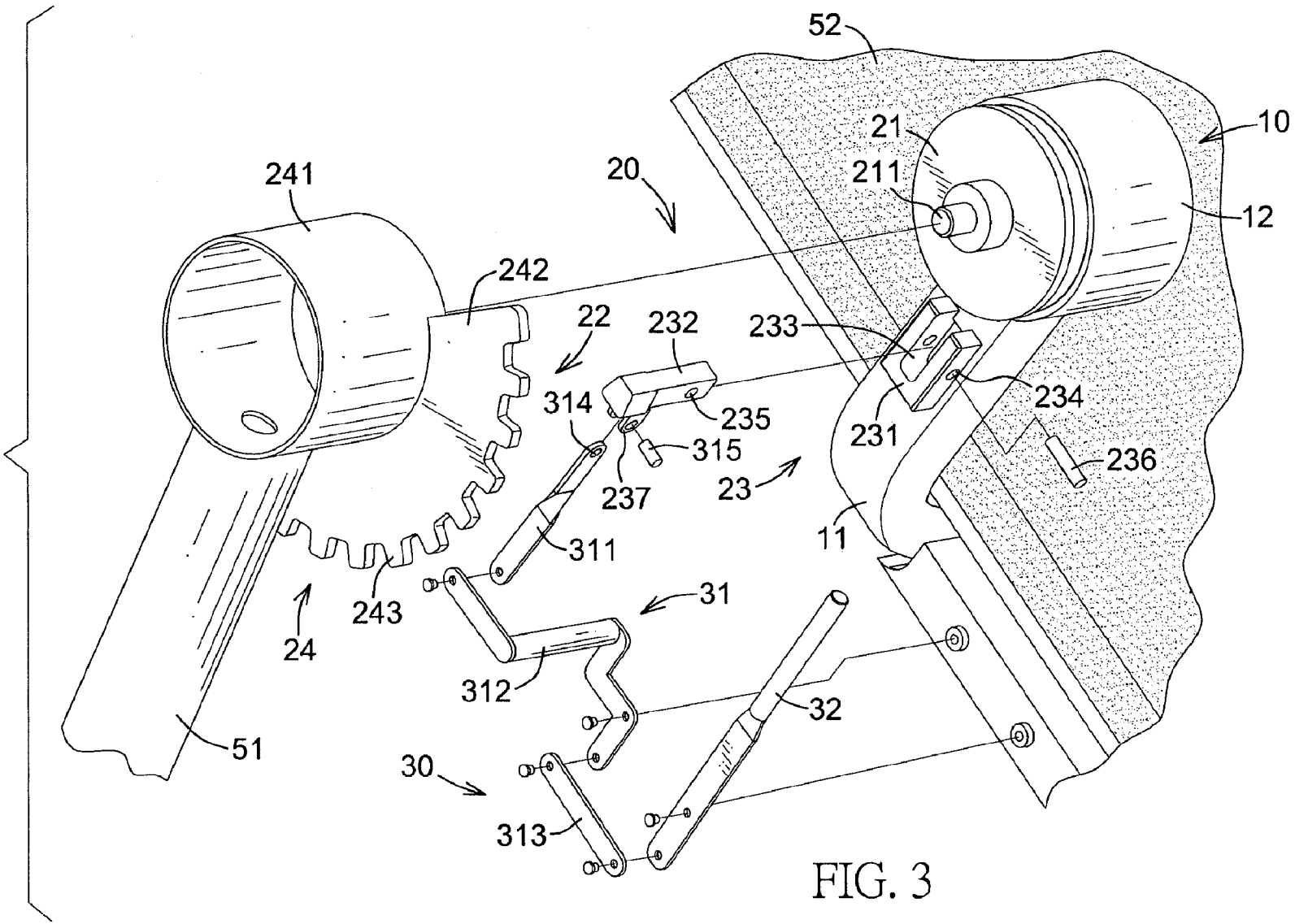
FIG. 3 is an enlarged exploded perspective view of the multi-stage orientating assembly in FIG. 1.
Figure 7:
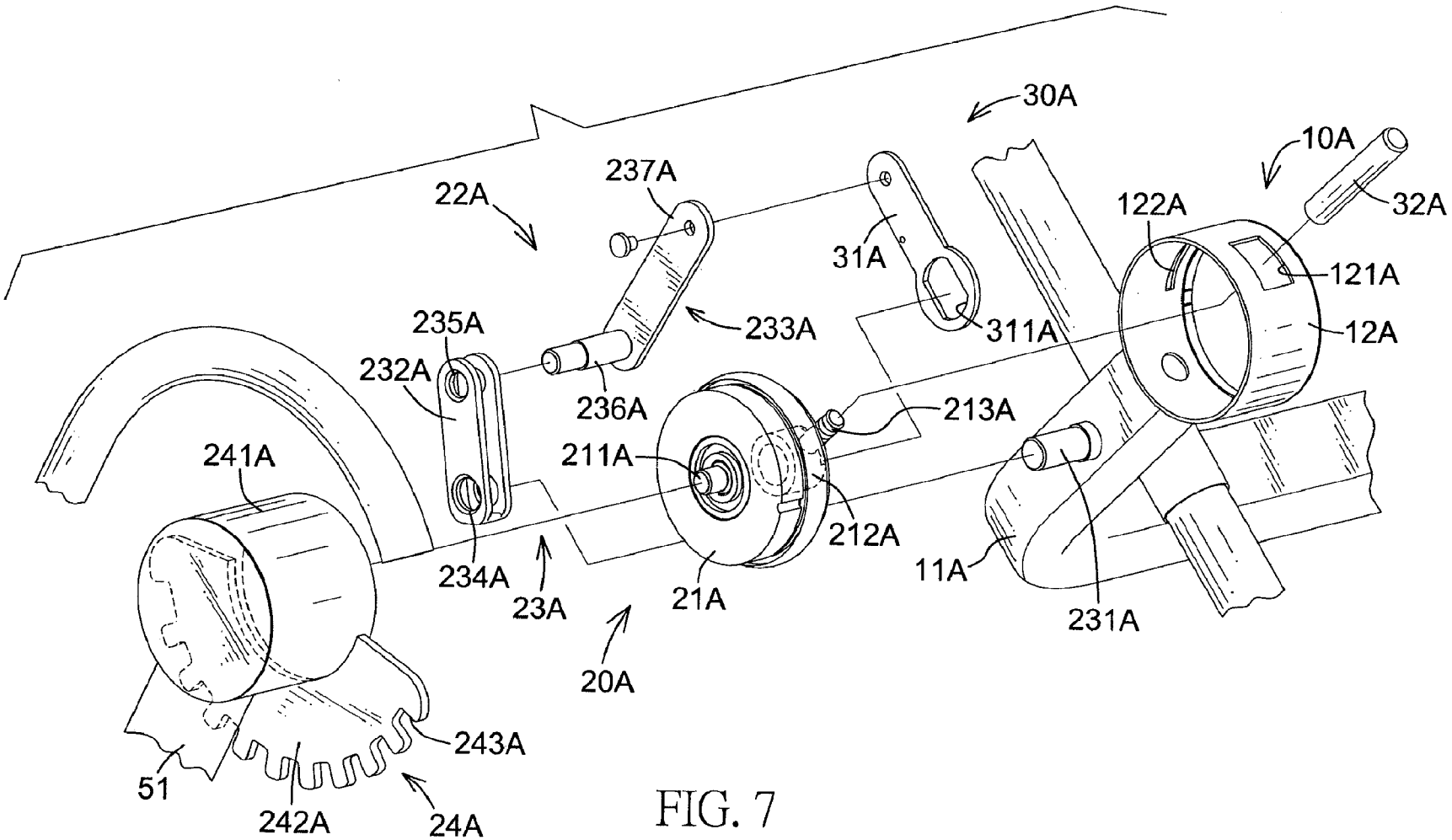
FIG. 7 is an enlarged exploded perspective view of the multi-stage orientating assembly in FIG. 6.
Figure 11:
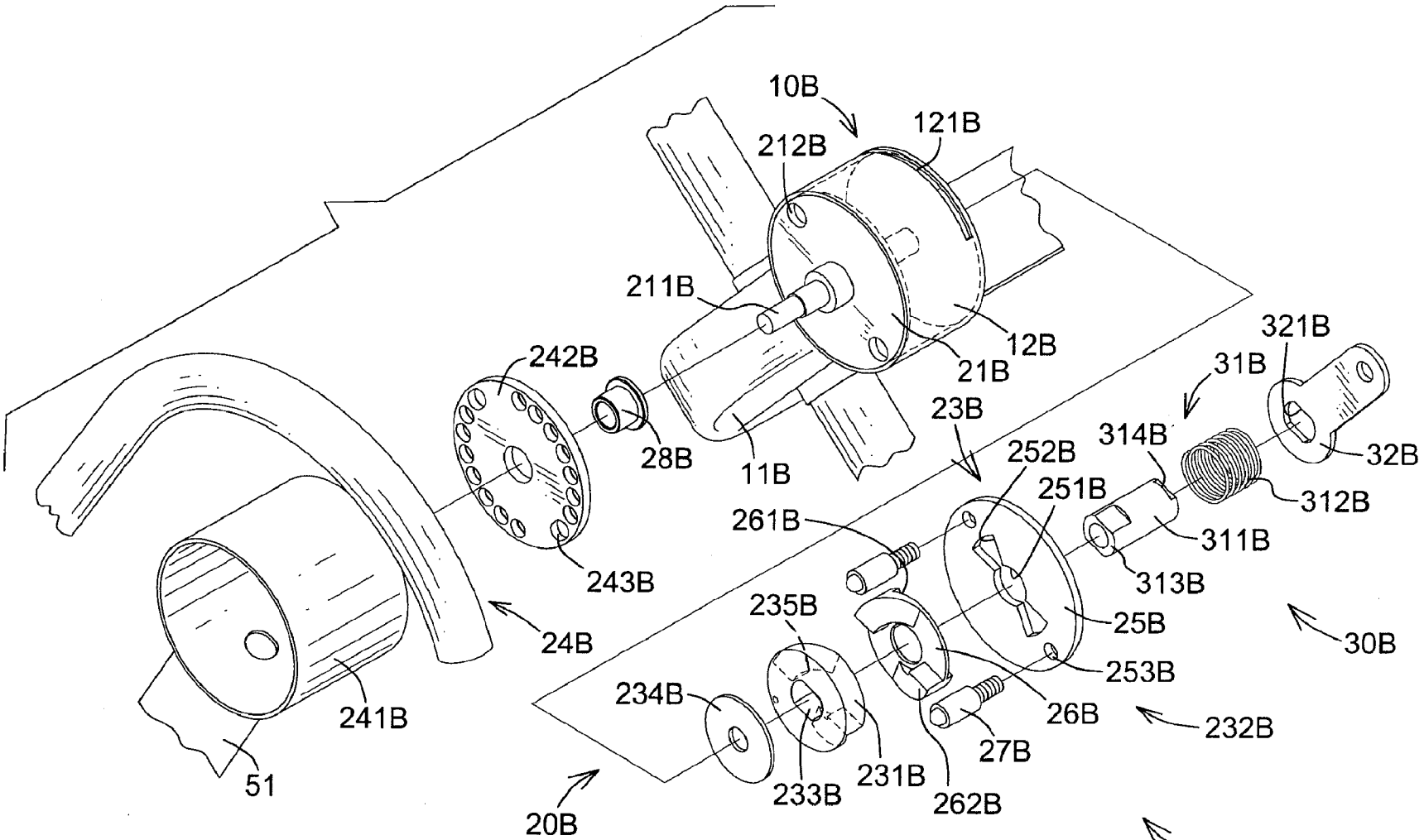
FIG. 11 is an enlarged exploded perspective view of the multi-stage orientating assembly in FIG. 10.

With further reference to FIGS. 3, 7 and 11, the orientating device (20, 20A, 20B) is connected to the mounting bracket (51) and the stationary seat (10, 10A, 10B) and has a mounting head (21, 21A, 21B) and a clamping device (22, 22A, 22B).

The mounting head (21, 21A, 21B) is connected to the connecting jacket (12, 12A, 12B) and has an inner side, an outer side, a center and a mounting rod (211, 211A, 211B). The inner side of the mounting head (21, 21A, 21B) is mounted securely in the chamber of the connecting jacket (12, 12A, 12B). The mounting rod.(211, 211A, 211B) is formed on the center of the mounting head (21) from the outer side.

The clamping device (22, 22A, 22B) is connected to the stationary seat (10, 10A, 10B) and has an engaging assembly (23, 23A, 23B) and an orientating assembly (24, 24A, 24B).

Figure 4:
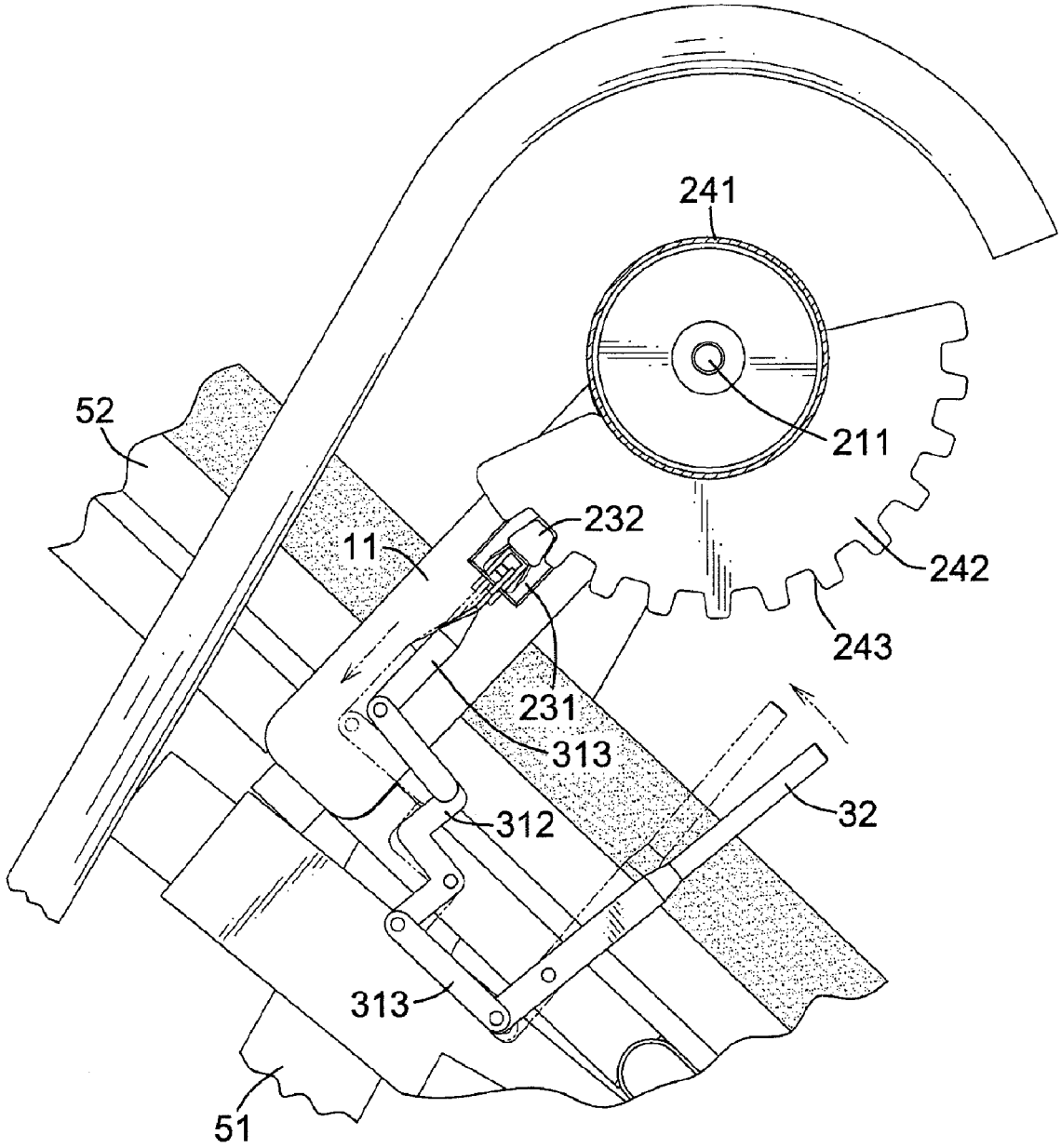
FIG. 4 is an enlarged operational side view of the multi-stage orientating assembly in FIG. 1.

With reference to FIGS. 3 and 4, the engaging assembly (23) is connected to the longitudinal beam (11) and has a base (231) and a latch arm (232). The base (231) may be U-shaped, is mounted securely on the longitudinal beam (11) below the connecting jacket (12) and has a top end, a recess (233) and a mounting hole (234). The recess (233) is formed through the top end of the base (231). The mounting hole (234) is formed transversely through the base (231) and communicates with the recess (233). The latch arm (232) is connected pivotally to the base (231) and has an inner end, an outer end, a bottom, a pivot hole (235), a pivot post (236) and two wings (237). The inner end of the latch arm (232) extends into the recess (233) of the base (231). The pivot hole (235) is formed through the inner end of the latch arm (232) and aligns with the mounting hole (234) of the base (231). The pivot post (236) extends into the mounting hole (234) in the base (231) and the pivot hole (235) in the latch arm (21) to connect the latch arm (232) pivotally with the base (231). The wings (237) protrude from the bottom near the outer end of the latch arm (232).

The orientating assembly (24, 24A, 24B) is connected securely to one of the top ends of the connecting bracket (51), is aligned with the mounting jacket (12, 12A, 12B) of the stationary seat (10, 10A, 10B) and has a mounting sheath (241, 241A, 241B) and a latch disk (242, 242A, 242B). The mounting sheath (241, 241A, 241B) is mounted transversely on a corresponding top end of the mounting bracket (51) of the inversion table (50), is aligned with the mounting head (21, 21A, 21B) and the connecting jacket (12, 12A, 12B) and has an external surface and an inner end. With reference to FIGS. 3 and 7, the latch disk (242, 242A) is formed on the external surface of the mounting sheath (241, 241A) near the inner end and has a periphery and multiple engaging holes (243, 243A). The engaging holes (243, 243A) are formed through the periphery of the latch disk (242, 242A). With reference to FIG. 11, the latch disk (242B) is securely attached to the mounting sheath (241B) and the engaging holes (243B) are formed through the latch disk (242B).

The operating device (30, 30A, 30B) is connected to the stationary seat (10, 10A, 10B) and the orientating device (20, 20A, 20B) and has a transmitting assembly (31, 31A, 31B) and a handle (32, 32A, 32B). The transmitting assembly (31, 31A, 31B) is connected to the engaging assembly (23, 23A, 23B). The handle (32, 32A, 32B) is connected securely to the transmitting assembly (31, 31A, 31B).

With reference to FIGS. 3 and 4, the transmitting assembly (31) is connected to the table (52) and the latch arm (232) of the engaging assembly (23) and has a linking arm (311), a connecting beam (312) and a mounting stick (313). The linking arm (311) is attached to the latch arm (232) and has a top end, a bottom end, a linking hole (314) and a mounting post (315). The top end of the linking arm (311) is pivotally connected to the wings (237) of the latch arm (232). The linking hole (314) is formed through the top end of the linking arm (311). The mounting post (315) extends through the wings (237) and the linking hole (314) to pivotally connect the linking arm (311) with the latch arm (232). The connecting beam (312) is pivotally connected to the linking arm (311) and the table (52) and has a front end, a middle and a lower end. The front end of the connecting beam (312) is pivotally connected to the bottom end of the linking arm (311). The connecting beam (312) is connected pivotally to the sidewall of the table (52) between the middle and the lower end. The mounting stick (313) is pivotally connected to the connecting beam (312) and has a first end and a second end. The first end of the mounting stick (313) is connected to the lower end of the connecting beam (312). The handle (32) is connected to the transmitting assembly (31) and the table (52) and has a proximal end and a distal end. The proximal end of the handle (32) is pivotally connected to the second end of the mounting stick (313). The handle (32) is attached pivotally to the sidewall of the table (52) near the proximal end.

Figure 5:
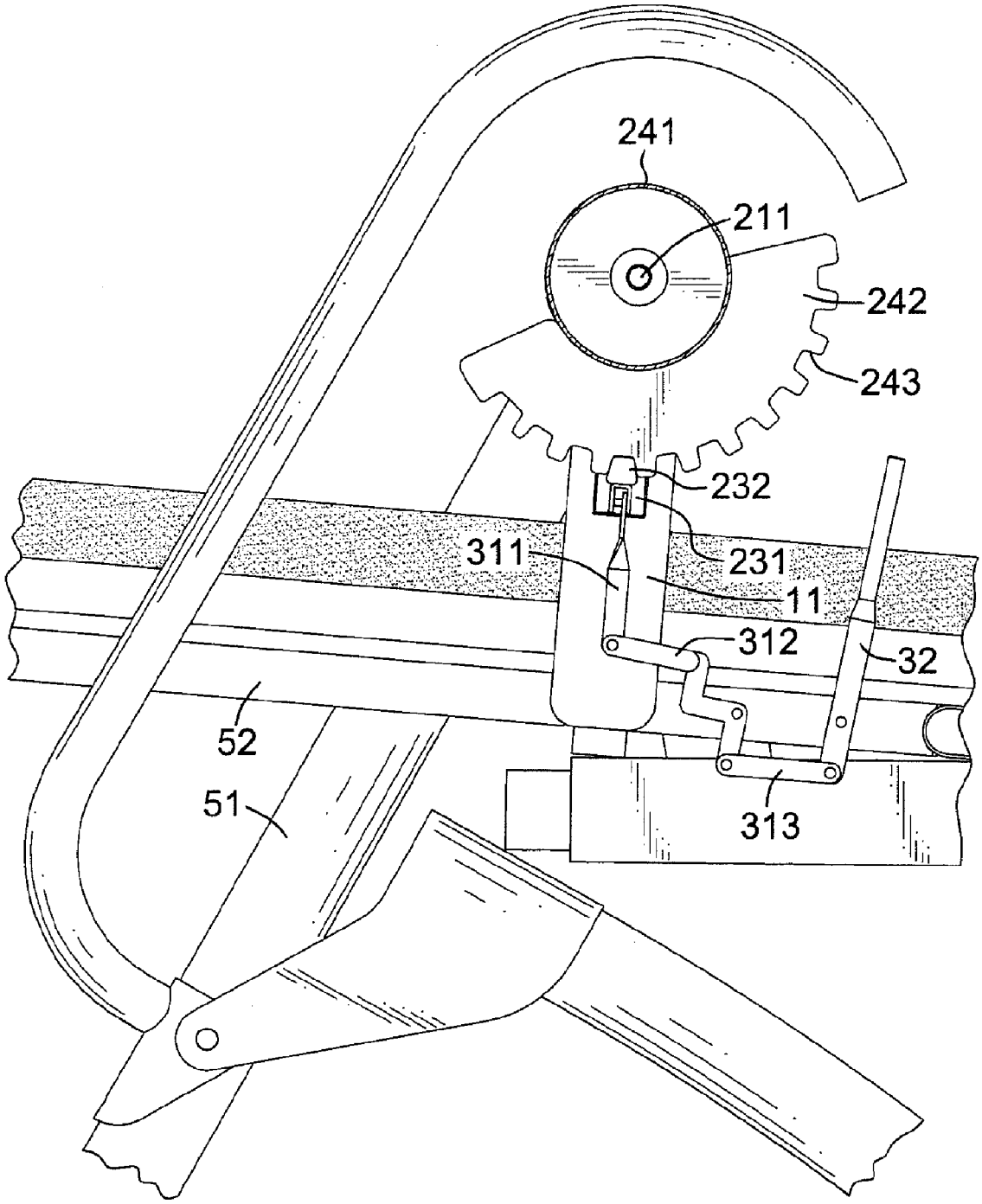
FIG. 5 is another enlarged side view of the multi-stage orientating assembly in FIG. 1.

With reference to FIGS. 4 and 5, when the distal end of the handle (32) is pushed to move relative to the table (52), the outer end of the latch arm (232) will be move to disengage from a corresponding engaging hole (243) of the latch disk (242) with the transmission of the mounting stick (313), the connecting beam (312) and the linking arm (311) of the transmitting assembly (31). Then, the table (52) can be rotated with an angle relative to the mounting bracket (51), and the handle (32) is pulled to make the outer end of the latch arm (232) engaging with a corresponding engaging hole (243) of the latch disk (242). Consequently, the table (52) can be adjusted with multiple angles relative to the mounting bracket (51) with the multi-stage orientating assembly.

With reference to FIGS. 6 and 7, the second embodiment of a multi-stage orientating assembly for an inversion table (50) in accordance with the present invention has a structure substantially same as that of the first embodiment except the follows.

The connecting jacket (12A) has a handle hole (121A) and an elongated hole (122A). The handle hole (121A) is formed through the outer surface of the connecting jacket (12A) near the inner end and communicates with the chamber. The elongated hole (122A) is formed through the connecting jacket (12A) and communicates with the chamber.

The mounting head (21A) has an extension tube (212A) and a threaded post (213A). The extension tube (212A) is formed on the center of the mounting head (21A) from the inner side and has an external surface and a free end. The threaded rod (213A) is formed on the external surface of the extension tube (212A) and is extended into the handle hole (121A) of the connecting jacket (12A).

The engaging assembly (23A) has a connecting shaft (231A), a mounting frame (232A) and a latch segment (233A). The connecting shaft (231A) is formed transversely on the longitudinal beam (11A) below the connecting jacket (12A). The mounting frame (232A) may be U-shaped, is connected pivotally to the connecting shaft (231A) and has a proximal end, a distal end, two connecting holes (234A) and two mounting holes (235A). The connecting holes (234A) are formed through the proximal end of the mounting frame (232A), and are mounted around the connecting shaft (231A). The mounting holes (235A) are respectively formed through the distal end of the mounting frame (232A). The latch segment (233A) is connected to the mounting frame (232A) and has a latch post (236A) and a connecting fin (237A). The latch post (236A) is connected to the mounting frame (232A), is engaged with a corresponding engaging hole (243A) of the latch disk (242A) and has an outer end and an inner end. The outer end of the latch post (236A) extends through the mounting holes (235A) of the mounting frame (232A). The connecting fin (237A) is connected securely to the latch post (236A) and has a bottom end and a top end. The bottom end of the connecting fin (237A) is connected securely to the inner end of the latch post (236A).

The transmitting assembly (31A) is a linking arm, is connected to the connecting fin (237A) and has an outer end, an inner end and a through hole (311A). The outer end of the transmitting assembly (31A) extends through the elongated hole (122A) of the connecting jacket (12A), and is connected to the top end of the connecting fin (237A). The inner end of the transmitting assembly (31A) is mounted in the chamber of the connecting jacket (12A). The through hole (311A) is formed through the inner end of the transmitting assembly (31A) and is mounted around a keyed free end of the extension tube (212A) of the mounting head (21A). The handle (32A) is connected securely to the threaded post (213A) and has a proximal end and a distal end. The proximal end of the handle (32A) extends into the chamber of the connecting jacket (12A) via the handle hole (121A) and is mounted around the threaded rod (213A) of the mounting head (21A). The distal end of the handle (32A) extends out the connecting jacket (12A) through the handle hole (121A).

Figure 8:
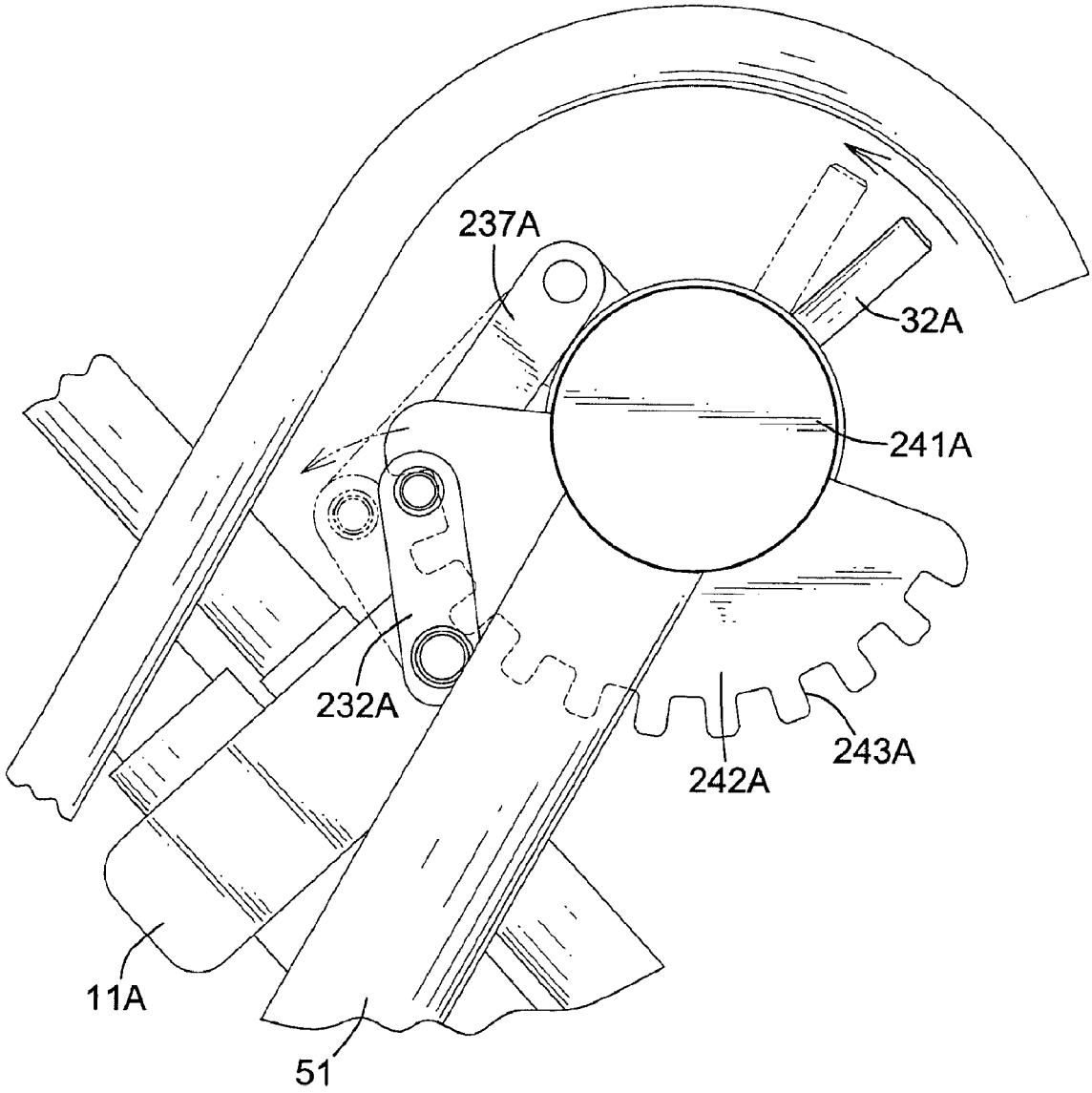
FIG. 8 is an enlarged operational side view of the multi-stage orientating assembly in FIG. 6.
Figure 9:
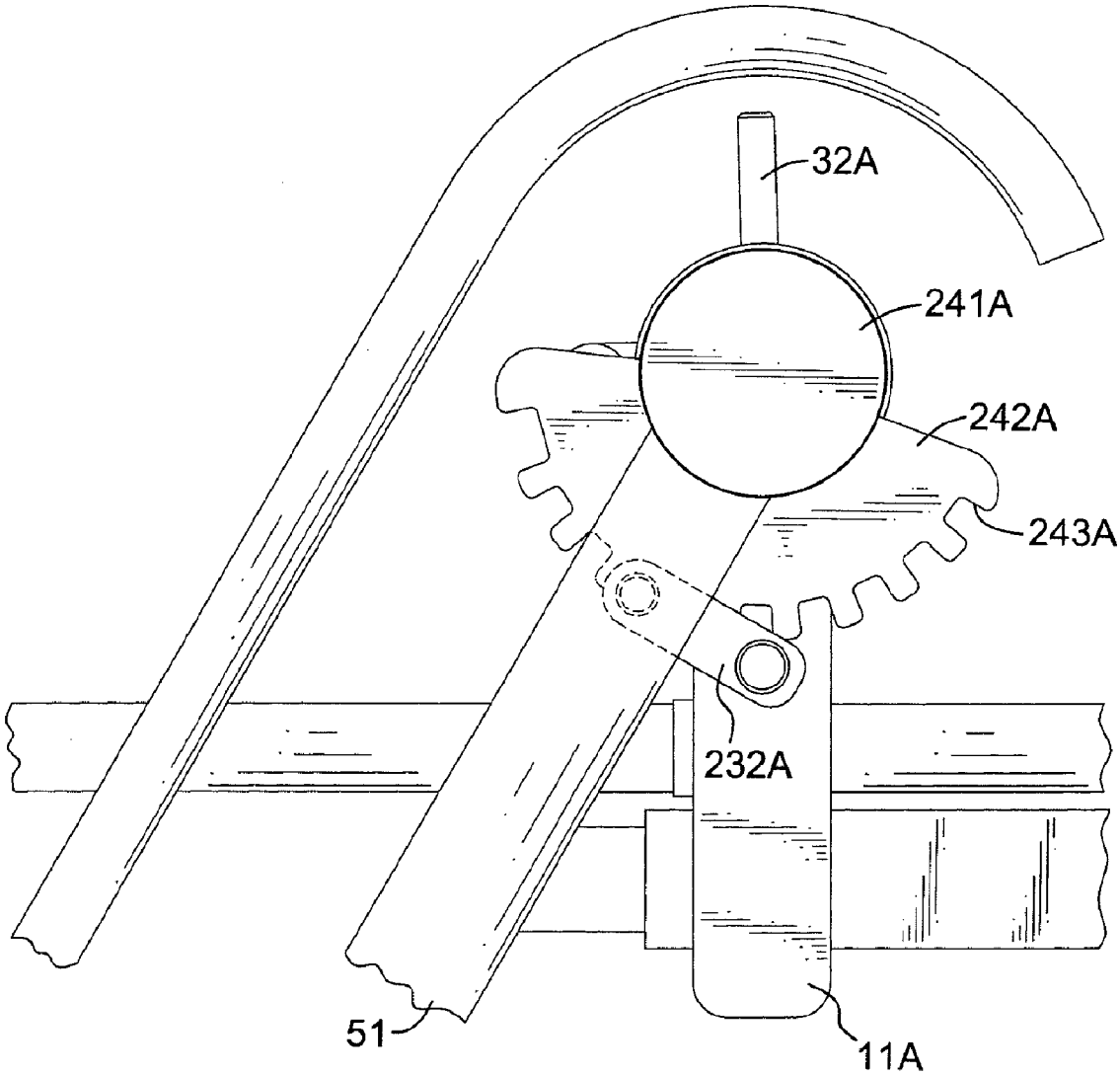
FIG. 9 is another enlarged side view of the multi-stage orientating assembly in FIG. 6.

With reference to FIGS. 7 to 9, when the distal end of the handle (32A) is pushed relative to the connecting jacket (12A), the mounting head (21A) will be rotated. The transmitting assembly (31A) will be moved by the extension tube (212A) and pull the connecting fin (237A) to move. The latch post (236A) will be moved with the connecting fin (237A) and depart from a corresponding engaging hole (243A) of the latch disk (242A). Then, the table (52) can be pivoted to an angle relative to the mounting bracket (51), and user can pull the handle (32A) to make the outer end of the latch post (236A) engage a corresponding engaging hole (243A) of the latch disk (242A). Consequently, the table (52) can be adjusted with multiple angles relative to the mounting bracket (51) with the multi-stage orientating assembly.

With reference to FIGS. 10 and 11, a third embodiment of multi-stage orientating assembly for an inversion table (50) in accordance with the present invention has a structure substantially same as that of the embodiments except the follows.

The connecting jacket (12B) further has a handle hole (121B). The handle hole (121B) is curved, is formed through the outer surface of the connecting jacket (12B) near the inner end and communicates with the chamber.

The mounting rod (211B) is formed through the center of the mounting head (21B) from the outer side to the inner side. The mounting head (21B) further has two through holes (212B). The through holes (212B) are formed through the mounting head (21B) and communicate with the chamber of the connecting jacket (12B).

The engaging assembly (23B) has a pressing ring (231B) and a latch segment (232B). The pressing ring (231B) is mounted in the chamber of the connecting jacket (12B), and is mounted securely around the mounting rod (211B) and has a center, an outer side, an inner side, a mounting hole (233B), a washer (234B) and two pressing blocks (235B). The mounting hole (233B) is noncircular, is formed through the center of the pressing ring (231B) and is mounted around the mounting rod (211B). The washer (234B) is connected to the mounting rod (211B) between the outer side of the pressing ring (231B) and the mounting head (21B). The pressing blocks (235B) are respectively formed on the inner side of the pressing ring (231B) and each pressing block (235B) has an inclined surface. The latch segment (232B) is connected to the mounting rod (211B) between the pressing ring (231B) and the handle hole (121B) of the connecting jacket (12B) and has a circular disk (25B), a pushing ring (26B) and two latch posts (27B). The circular disk (25B) is connected to the mounting rod (211B) and has a center, a through hole (25 1B), two inserting holes (252B) and two threaded holes (253B). The through hole (251B) is formed through the center of the circular disk (25B) and is mounted around the mounting rod (211B). The inserting holes (252B) are respectively formed through the circular disk (25B) and communicate with the through hole (251B). The threaded holes (253B) are formed through the circular disk (25B) and are respectively aligned with the through holes (212B) of the mounting head (21B).

The pushing ring (26B) is connected to the mounting rod (211B) between the circular disk (25B) and the pressing ring (231B) and has an inner side, an outer side, two inserting blocks (261B) and two pushing blocks (262B). The inserting blocks (261B) are formed on the inner side of the pushing ring (26B), and respectively engage with the inserting holes (252B) of the circular disk (25B). The pushing blocks (262B) are formed on the outer side of the pushing ring (26B) and are aligned and abut with the pressing blocks (235B) on the pressing ring (231B), respectively. Each pushing block (262B) has an inclined pushing surface abutting with the inclined surface of a corresponding pressing block (235B). The latch posts (27B) are connected securely to the circular disk (25B) and each latch post (27B) has a proximal end and a distal end. The proximal ends of the latch posts (27B) are respectively screwed into the threaded holes (253B) of the circular disk (25B). The distal ends of the latch posts (27B) respectively extend through the through holes (212B) of the mounting head (21B).

The latch disk (242B) is mounted in the mounting sheath (241B) and is mounted around the mounting rod (211B) with a bearing (28B). The engaging holes (243B) in the latch disk (242B) correspond to and selective engage the distal ends of the latch posts (27B).

The transmitting assembly (31B) has a connecting pipe (311B) and a spring (312B). The connecting pipe (311B) is mounted around the mounting rod (211B) and is connected to the pressing ring (231B) and has a front end (313B) and a rear end (314B). The front end (313B) extends through the circular disk (25B) and the pushing ring (26B) and is connected securely to the mounting hole (233B) of the pressing ring (231B). The spring (312B) is mounted around the connecting pipe (311B) and abuts with the circular disk (25B). The handle (32B) is connected securely to the connecting pipe (311B) and has a proximal end, a distal end and a connecting hole (321B). The proximal end of the handle (32B) extends into the chamber of the connecting jacket (12B) through the handle hole (121B), and is connected with the connecting pipe (311B). The connecting hole (321B) is formed through the proximal end of the handle (32B), and is connected with the rear end of the connecting pipe (311B).

Figure 12:
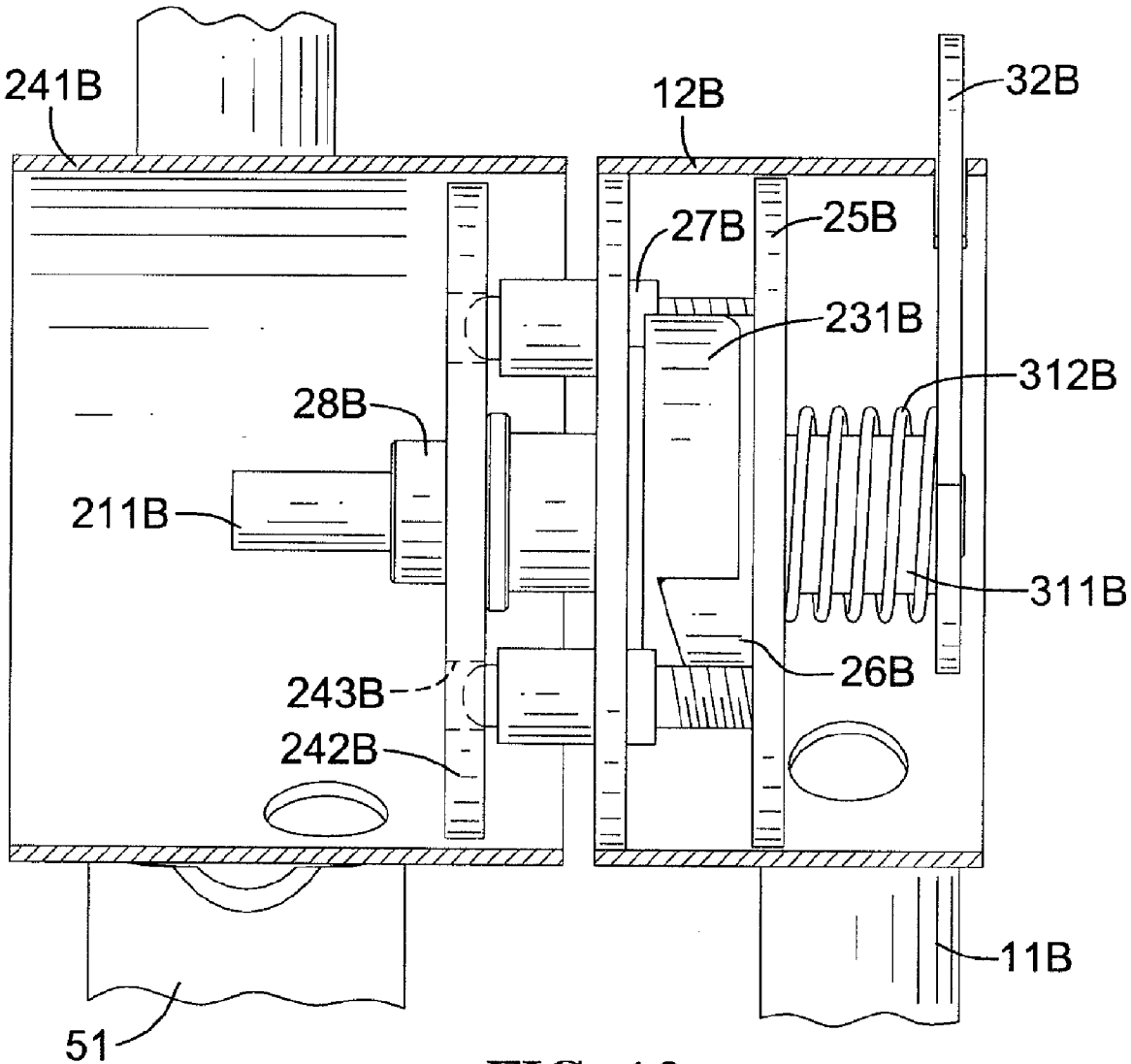
FIG. 12 is an enlarged side view in partial section of the multi-stage orientating assembly in FIG. 10.
Figure 13:
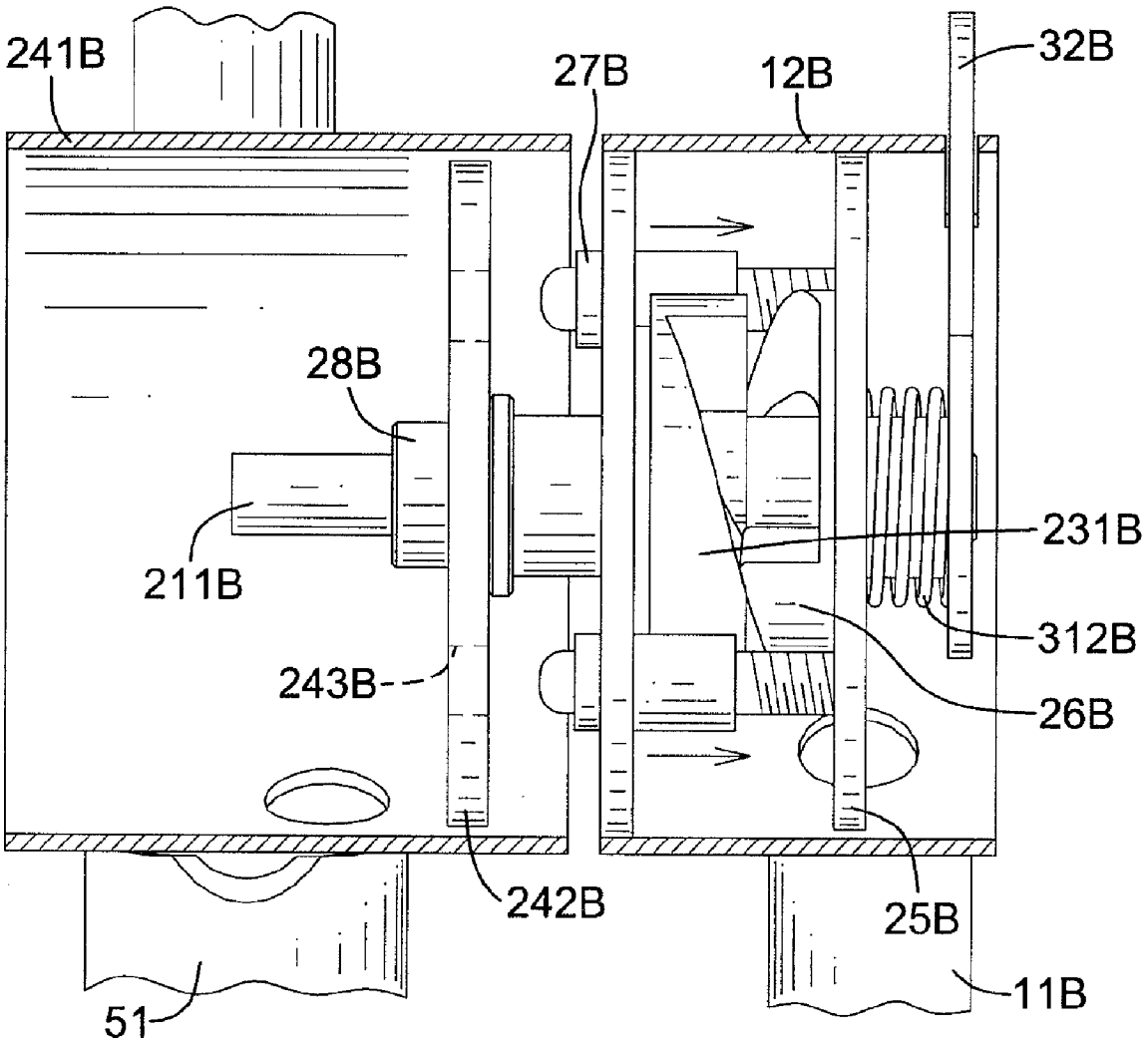
FIG. 13 is an enlarged operational side view in partial section of the multi-stage orientating assembly in FIG. 10.

With reference to FIGS. 12 and 13, when the distal end of the handle (32B) is pushed relative to the connecting jacket (12B), the connecting pipe (311B) will make the pressing ring (231B) rotating relative to the pushing ring (26B). With the abutment of the inclined surfaces of the pressing blocks (235B) of the pressing ring (231B) with the inclined pushing surfaces of the pushing blocks (262B) of the pushing ring (26B), the circular disk (25B) will move with the pushing ring (26B) along the connecting pipe (311B) and press the spring (312B). When the circular disk (25B) moves to the handle (32B), the latch posts (27B) move out from the engaging holes (243B) of the latch disk (242B). Consequently, the table (52) can be adjusted at multiple angles relative to the mounting bracket (51) with the multi-stage orientating assembly. When user releases the handle (32B), the spring (312B) will push against the circular disk (25B) to move toward the pressing ring (231B). The latch posts (27B) will extend into corresponding engaging holes (243B) of the latch disk (242*b*) to latch the table (52) securely with mounting bracket (51) of the inversion table (50) at a desired angle.

The multi-stage orientating assembly for an inversion table (50) as described has the following advantages:

1. The stationary seat (10, 10A, 10B), the orientating device (20, 20A, 20B) and the operating device (30, 30A, 30B) provide a simplified structure to adjust the multi-stage orientating assembly easily and quickly.

2. The multi-stage orientating assembly for the inversion table (50) can adjust the table (52) at multiple angles relative to the mounting bracket (51) of the inversion table (50).

3. The multi-stage orientating assembly for the inversion table (50) with multiple inverted angles can attract user to exercise with the inversion table (50).

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A multi-stage orientating assembly for an inversion table having a mounting bracket and a table, the multi-stage orientating assembly adapted to be connected to the inversion table between the mounting bracket and the table and comprising:

a stationary seat being adapted to connect securely to a sidewall of the table of the inversion table and having a longitudinal beam being adapted to connect securely to the table of the inversion table and having a bottom end adapted to be connected securely to a bottom face of the table; and a top end adapted to protrude up from the table; and a connecting jacket being hollow, being mounted securely to the top end of the longitudinal beam and having an inner end;

an outer end;

an outer surface;

a chamber;

a handle hole being formed through the outer surface of the connecting jacket near the inner end and communicating with the chamber; and an elongated hole being formed through the connecting jacket and communicating with the chamber;

an orientating device being connected to the mounting bracket and the stationary seat and having a mounting head being connected to the connecting jacket and having an inner side being mounted securely in the chamber of the connecting jacket;

an outer side;

a center;

a mounting rod being formed on the center of the mounting head from the outer side; and an extension tube being formed on the center of the mounting head from the inner side and having an external surface; and a free end; and a threaded post being formed on the external surface of the extension tube, and being extended into the handle hole of the connecting jacket; and a clamping device being connected to the stationary seat and having an engaging assembly; and an orientating assembly adapted to be connected securely to a top end of the mounting bracket, being aligned with the connecting jacket of the stationary seat and having a mounting sheath adapted to be mounted transversely on the corresponding top end of the mounting bracket of the inversion table, being aligned with the mounting head and the connecting jacket and having an external surface; and an inner end; and a latch disk; and an operating device being connected to the stationary seat and the orientating device and having a transmitting assembly being connected to the engaging assembly of the clamping device; and a handle being connected securely to the transmitting assembly.

2. The multi-stage orientating assembly for an inversion table as claimed in claim 1, wherein the engaging assembly has a connecting shaft being formed transversely on the longitudinal beam below the connecting jacket;

a mounting frame being U-shaped, being connected pivotally to the connecting shaft and having a proximal end;

a distal end;

two connecting holes being formed through the proximal end of the mounting frame, and being mounted around the connecting shaft; and two mounting holes being formed through the distal end of the mounting frame; and a latch segment being connected to the mounting frame and having a latch post being connected to the mounting frame, being engaged with a corresponding engaging hole of the latch disk and having an outer end extending through the mounting holes of the mounting frame; and an inner end; and a connecting fin being connected securely to the latch post and having a bottom end being connected securely to the inner end of the latch post; and a top end.

3. The multi-stage orientating assembly for an inversion table as claimed in claim 2, wherein the latch disk is formed on the external surface of the mounting sheath near the inner end and has a periphery; and multiple engaging holes being formed through the periphery of the latch disk.

4. The multi-stage orientating assembly for an inversion table as claimed in claim 3, wherein the transmitting assembly being a linking arm, being connected to the connecting fin and having an outer end extending through the elongated hole of the connecting jacket, and being connected to the top end of the connecting fin;

an inner end being mounted in the chamber of the connecting jacket; and a through hole being formed through the inner end of the transmitting assembly and being mounted around the free end of the extension tube of the mounting head; and the handle being connected securely to the threaded post and having a proximal end extending into the chamber of the connecting jacket via the handle hole and being mounted around the threaded rod of the mounting head; and a distal end extending out the connecting jacket through the handle hole.

* * * * *